US006178947B1

(12) United States Patent
Machida et al.

(10) Patent No.: US 6,178,947 B1
(45) Date of Patent: Jan. 30, 2001

(54) CONTROL APPARATUS FOR INTERNAL COMBUSTION ENGINE WITH ELECTRONICALLY-CONTROLLED THROTTLE SYSTEM

(75) Inventors: Kenichi Machida, Gunma; Masahiro Iriyama; Hideki Hyoudou, both of Yokohama; Masaru Mizuguchi, Kanagawa; Mikio Nozaki, Kangawa, all of (JP)

(73) Assignees: Unisia Jecs Corporation, Atsugi; Nissan Motor Co., Ltd., Yokohama, both of (JP)

( * ) Notice: Under 35 U.S.C. 154(b), the term of this patent shall be extended for 0 days.

(21) Appl. No.: 09/384,438

(22) Filed: Aug. 27, 1999

(30) Foreign Application Priority Data

Aug. 28, 1998 (JP) ..... 10-244114

(51) Int. Cl.[7] ..... F02D 11/10
(52) U.S. Cl. ..... 123/396; 123/397; 123/399
(58) Field of Search ..... 123/396, 397, 123/398, 399

(56) References Cited

U.S. PATENT DOCUMENTS 4,898,138 * 2/1990 Nishimura et al. ..... 123/399
4,969,431 * 11/1990 Wataya ..... 123/399
4,993,384 * 2/1991 Wiggins et al. ..... 123/399
5,170,769 * 12/1992 Berger et al. ..... 123/399
5,224,453 * 7/1993 Bederna et al. ..... 123/479
5,327,865 * 7/1994 Riehemann ..... 123/399
5,447,134 * 9/1995 Yokoyama ..... 123/399
5,875,760 * 3/1999 Bauer et al. ..... 123/399
5,927,250 * 7/1999 Nishida ..... 123/399
6,073,610 * 6/2000 Matsumoto et al. ..... 123/396
6,089,535 * 7/2000 Mizutani et al. ..... 123/399

FOREIGN PATENT DOCUMENTS 7-180570 7/1995 (JP) .

* cited by examiner

*Primary Examiner*—Erick Solis
(74) *Attorney, Agent, or Firm*—Foley & Lardner

(57) ABSTRACT

In a computer-controlled internal combustion engine with an electronically-controlled throttle system, a duplex throttle-position sensor system, a duplex accelerator-position sensor system, and other engine/vehicle sensors/switches, a sensor-failure detection and fail-safe system is configured to be electronically connected to the two throttle position sensors, the two accelerator position sensors and a vehicle-deceleration sensor for responding to a failure in at least one of the two throttle position sensors and the two accelerator position sensors for failsafe purposes. The sensor-failure detection and fail-safe system comprises a duplex failsafe system for the throttle-position sensor system and a duplex failsafe system for the accelerator-position sensor system, to provide superior fail-safe functions despite the presence of a throttle-position sensor failure and/or an accelerator-position sensor failure.

21 Claims, 2 Drawing Sheets

CONTROL APPARATUS FOR INTERNAL COMBUSTION ENGINE WITH ELECTRONICALLY-CONTROLLED THROTTLE SYSTEM

BACKGROUND OF THE INVENTION

Field of the Invention

The present invention relates to a computer-controlled internal combustion engine equipped with an electronically-controlled throttle system capable of electronically controlling the opening of the throttle valve, and more specifically to techniques for executing a fail-safe control routine in presence of a failure or an abnormality in a throttle position sensor located on the throttle body of an electronically-controlled throttle system and/or in an accelerator position sensor monitoring the amount of depression of an accelerator pedal.

There are two typical types of electronically-controlled throttle systems, one being a so-called half-electronically-controlled throttle system and a so-called full-electronically-controlled throttle system. The former half-electronically-controlled throttle system has a manually-wire-operated throttle valve as well as an electronically-controlled throttle valve which is commanded by an electronic engine control unit (ECU) or an electronic control module (ECM).

Usually, the electronically-controlled throttle valve is operated arbitrarily in response to an instruction of the ECU, based on engine/vehicle operating conditions, such as the amount of depression of an accelerator pedal or the like. In the presence of a failure either elsewhere in the ECU or within the sensor systems (such as, shorted/opened sensor input signals), the throttle control system switches from the full-electronically-controlled throttle system to the manually-wire-operated throttle system, so that the opening of the throttle valve is manually adjusted depending on the accelerator pedal travel. One such half-electronically-controlled throttle system has been disclosed in Japanese Patent Provisional Publication No. 7-180570.

Later models of full-electronically-controlled throttle systems utilize input informational signal data from two accelerator position sensors and two throttle position sensors. Generally, the ECU uses or selects a lower one of the sensor signals from the two accelerator position sensors byway of a so-called select-LOW process.

With respect to the throttle-opening indicative data, the ECU uses an input signal from a main throttle position sensor out of the two throttle position sensors, or selects a higher one of the sensor signals from the two throttle position sensors by way of a so-called select-HIGH process. If the failure occurs in either one of the two throttle position sensors of the duplex throttle-position sensor system, the throttle control system ordinarily de-activates the throttle actuator, so as to hold the opening of the electronically-controlled throttle valve at a predetermined "default" opening or a predetermined "fail-safe" opening, thereby putting the engine into its limp-home mode (or limp-in mode). The limp-home mode allows the engine/vehicle to be run/driven but with greatly reduced performance, (for example, the vehicle can limp in at a maximum speed of 40 Km/h). It is so inconvenient.

SUMMARY OF THE INVENTION

In case of a detected defective throttle-position sensor, it is rational and desirable to properly control the opening of an electronically-controlled throttle valve, using the input information signal from the other sensor (e.g., the other throttle position sensor in a duplex throttle-position sensor system). Furthermore, if the other throttle position sensor fails or operates abnormally, it is desirable to substitute a default opening (a fail-safe opening) for the second failed sensor. Accordingly, it is an object of the invention to provide an integrated engine control system which is capable of assuring a high-quality, reliable internal combustion engine with an electronically-controlled throttle system, by at least a duplex fail-safe system despite the presence of throttle-position sensor failures or faults.

It is another object of the invention to provide an integrated engine control system which is capable of assuring a high-quality, reliable internal combustion engine with an electronically-controlled throttle system, by at least a duplex fail-safe system despite the presence of accelerator-position sensor failures or faults.

It is a still further object of the invention to provide an integrated engine control system which is capable of assuring a high-quality, reliable internal combustion engine with an electronically-controlled throttle system, by at least a duplex fail-safe system for a throttle-position sensor system despite the presence of a throttle-position sensor failure or fault and by at least a duplex fail-safe system for an accelerator-position sensor system despite the presence of an accelerator-position sensor failure or fault.

In order to accomplish the aforementioned and other objects of the present invention, a control apparatus for an internal combustion engine with an electronically-controlled throttle system having a throttle valve disposed in an induction system and an actuator operating the throttle valve so that an opening of the throttle valve is adjusted to a desired opening, comprises a duplex throttle-position sensor system having two throttle position sensors each detecting the opening of the throttle valve, a vehicle-deceleration sensor detecting a decelerating condition of the engine and generating a deceleration indicative signal, and a fail-safe system configured to be electronically connected to the two throttle position sensors and the vehicle-deceleration sensor for responding to a failure in at least one of the two throttle position sensors for failsafe purposes, the fail-safe system comprising a first failsafe section which controls the opening of the throttle valve by a sensor signal value from an unfailed throttle position sensor of the two throttle position sensors at a single throttle-position sensor failure mode where one of the two throttle position sensors is failed, to initiate a first failsafe mode, a second failsafe section which inhibits the first failsafe mode in response to the deceleration indicative signal from the vehicle-deceleration sensor during the first failsafe mode and holds the throttle valve at a predetermined default opening, to initiate a second failsafe mode, and a third failsafe section which detects if the sensor signal value from the unfailed throttle position sensor is within a predetermined sensor-abnormality diagnostic criterion range during the second failsafe mode, and unconditionally continues to hold the opening of the throttle valve at the predetermined default opening when the sensor signal value from the unfailed throttle position sensor is out of the predetermined sensor-abnormality diagnostic criterion range.

According to another aspect of the invention, a control apparatus for an internal combustion engine with an electronically-controlled throttle system having a throttle valve disposed in an induction system and an actuator operating the throttle valve so that an opening of the throttle valve is adjusted to a desired opening, comprises a duplex throttle-position sensor system having two throttle position sensors each detecting the opening of the throttle valve, a duplex accelerator-position sensor system having two accelerator position sensors each detecting an amount of depression of an accelerator pedal, a vehicle-deceleration sensor detecting a decelerating condition of the engine and generating a deceleration indicative signal, and a fail-safe system configured to be electronically connected to the two throttle position sensors, the two accelerator position sensors and the vehicled-deceleration sensor for responding to a failure in at least one of the two throttle position sensors and the two accelerator position sensors for failsafe purposes, the fail-safe system comprising a first failsafe section which feedback-controls the opening of the throttle valve by a sensor signal value from an unfailed throttle position sensor of the two throttle position sensors at a single throttle-position sensor failure mode where one of the two throttle position sensors is failed, to initiate a first failsafe mode, a second failsafe section which inhibits the first failsafe mode in response to the deceleration indicative signal from the vehicle-deceleration sensor during the first failsafe mode and holds the throttle valve at a predetermined default opening, to initiate a second failsafe mode, a third failsafe section which detects if the sensor signal value from the unfailed throttle position sensor is within a predetermined sensor-abnormality diagnostic criterion range during the second failsafe mode, and unconditionally continues to hold the opening of the throttle valve at the predetermined default opening when the sensor signal value from the unfailed throttle position sensor is out of the predetermined sensor-abnormality diagnostic criterion range, a fourth failsafe section which sets the desired opening of the throttle valve based on a sensor signal value from an unfailed accelerator position sensor of the two accelerator position sensors at a single accelerator-position sensor failure mode where one of the two accelerator position. sensors is failed and feedback-controls the opening of the throttle valve by the desired opening based on the sensor signal value from the unfailed accelerator position sensor, to initiate a fourth failsafe mode, and a fifth failsafe section which detects if the sensor signal value from the unfailed accelerator position sensor is above a predetermined threshold value correlating with an idling condition of the engine during the fourth failsafe mode and during idling, and unconditionally continues to hold the opening of the throttle valve at the predetermined default opening when the sensor signal value from the unfailed accelerator position sensor is above the predetermined threshold value. Preferably, the second failsafe section inhibits the fourth failsafe mode in response to the deceleration indicative signal during the fourth failsafe mode and holds the throttle valve at the predetermined default opening.

According to a further aspect of the invention, in computer-controlled internal combustion engine with an electronically-controlled throttle system having a throttle valve disposed in an induction system and an actuator operating the throttle valve so that an opening of the throttle valve is adjusted to a desired opening, a duplex throttle-position sensor system having two throttle position sensors each detecting the opening of the throttle valve, a vehicle-deceleration sensor detecting a decelerating condition of the engine and generating a deceleration indicative signal, and a sensor-failure detection and fail-safe system configured to be electronically connected to the two throttle position sensors and the vehicle-deceleration sensor for responding to a failure in at least one of the two throttle position sensors for failsafe purposes, comprises a first failsafe means for feed back controlling the opening of the throttle valve by a sensor signal value from an unfailed throttle position sensor of the two throttle position sensors at a single throttle-position sensor failure mode where one of the two throttle position sensors is failed, to initiate a first failsafe mode, a second failsafe means for inhibiting the first failsafe mode in response to the deceleration indicative signal from the vehicle-deceleration sensor during the first failsafe mode and holding the throttle valve at a predetermined default opening, to initiate a second failsafe mode, and a third failsafe means having a window comparator for executing a diagnosis on abnormality in the unfailed throttle position sensor by comparing the sensor signal value from the unfailed throttle position sensor with a predetermined sensor-abnormality diagnostic criterion range during the second failsafe mode, and determining that the unfailed throttle position sensor is operating abnormally when the sensor signal value from the unfailed throttle position sensor is out of the predetermined sensor-abnormality diagnostic criterion range, and unconditionally continuing to hold the opening of the throttle valve at the predetermined default opening when the unfailed throttle position sensor is operating abnormally.

According to a still further aspect of the invention, in a computer-controlled internal combustion engine with an electronically-controlled throttle system having a ,throttle valve disposed in an induction system and an actuator operating the throttle valve so that an opening of the throttle valve is adjusted to a desired opening, a duplex throttle-position sensor system having two throttle position sensors each detecting the opening of the throttle valve, a duplex accelerator-position sensor system having two accelerator position sensors each detecting an amount of depression of an accelerator pedal, a vehicle-deceleration sensor detecting a decelerating condition of the engine and generating a deceleration indicative signal, and a sensor-failure detection and fail-safe system configured to be electronically connected to the two throttle position sensors, the two accelerator position sensors and the vehicle-deceleration sensor for responding to a failure in at least one of the two throttle position sensors and the two accelerator position sensors for failsafe purposes, comprises a first failsafe means for feedback-controlling the opening of the throttle valve by a sensor signal value from an unfailed throttle position sensor of the two throttle position sensors at a single throttle-position sensor failure mode where one of the two throttle position sensors is failed, to initiate a first failsafe mode, a second failsafe means for inhibiting the first failsafe mode in response to the deceleration indicative signal from the vehicle-deceleration sensor during the first failsafe mode and holding the throttle valve at a predetermined default opening, to initiate a second failsafe mode, a third failsafe means having a window comparator for executing a diagnosis on abnormality in the unfailed throttle position sensor by comparing the sensor signal value from the unfailed throttle position sensor with a predetermined sensor-abnormality diagnostic criterion range during the second failsafe mode, and determining that the unfailed throttle position sensor is operating abnormally when the sensor signal value from the unfailed throttle position sensor is out of the predetermined sensor-abnormality diagnostic criterion range, and unconditionally continuing to hold the opening of the throttle valve at the predetermined default opening when the unfailed throttle position sensor is operating abnormally, a fourth failsafe means for setting the desired opening of the throttle valve based on a sensor signal value from an unfailed accelerator position sensor of the two accelerator position sensors at a single accelerator-position sensor failure mode where one of the two accelerator position sensors is failed and feedback-controlling the opening of the throttle valve by the desired opening based on the sensor signal value from the unfailed accelerator position sensor, to initiate a fourth failsafe mode, and a fifth failsafe means having a comparator for executing a diagnosis on abnormality in the unfailed accelerator position sensor by comparing the sensor signal value from the unfailed accelerator position sensor with a predetermined threshold value correlating with an idling condition of the engine during the fourth failsafe mode and during idling, and determining that the unfailed accelerator position sensor is operating abnormally when the sensor signal value from the unfailed accelerator position sensor is above the predetermined threshold value, and unconditionally continuing to hold the opening of the throttle valve at the predetermined default opening when the unfailed accelerator position sensor is operating abnormally.

According to another aspect of the invention, a method for executing failsafe functions for a computer-controlled internal combustion engine with an electronically-controlled throttle system having a throttle valve disposed in an induction system and an actuator operating the throttle valve so that an opening of the throttle valve is adjusted to a desired opening, a duplex throttle-position sensor system having two throttle position sensors each detecting the opening of the throttle valve, a vehicle-deceleration sensor detecting a decelerating condition of the engine and generating a deceleration indicative signal, and a sensor-failure detection and fail-safe system configured to be electronically connected to the two throttle position sensors and the vehicle-deceleration sensor for responding to a failure in at least one of the two throttle position sensors for failsafe purposes, the method comprises feedback-controlling the opening of the throttle valve by a sensor signal value from an unfailed throttle position sensor of the two throttle position sensors at a single throttle-position sensor failure mode where one of the two throttle position sensors is failed, to initiate a first failsafe mode, inhibiting the first failsafe mode in response to the deceleration indicative signal from the vehicle-deceleration sensor during the first failsafe mode and holding the throttle valve at a predetermined default opening, to initiate a second failsafe mode, executing a diagnosis on abnormality in the unfailed throttle position sensor by comparing the sensor signal value from the unfailed throttle position sensor with a predetermined sensor-abnormality diagnostic criterion range during the second failsafe mode, determining that the unfailed throttle position sensor is operating abnormally when the sensor signal value from the unfailed throttle position sensor is out of the predetermined sensor-abnormality diagnostic criterion range, and unconditionally continuing to hold the opening of the throttle valve at the predetermined default opening when the unfailed throttle position sensor is operating abnormally.

According to another aspect of the invention, a method for executing failsafe functions for a computer-controlled internal combustion engine with an electronically-controlled throttle system having a throttle valve disposed in an induction system and an actuator operating the throttle valve so that an opening of the throttle valve is adjusted to a desired opening, a duplex throttle-position sensor system having two throttle position sensors each detecting the opening of the throttle valve, a duplex accelerator-position sensor system having two accelerator position sensors each detecting an amount of depression of an accelerator pedal, a vehicle-deceleration sensor detecting a decelerating condition of the engine and generating a deceleration indicative signal, and a sensor-failure detection and fail-safe system configured to be electronically connected to the two throttle position sensors, the two accelerator position sensors and the vehicle-deceleration sensor for responding to a failure in at least one of the two throttle position sensors and the two accelerator position sensors for failsafe purposes, the method comprises feedback-controlling the opening of the throttle valve by a sensor signal value from an unfailed throttle position sensor of the two throttle position sensors at a single sensor failure mode where one of the two throttle position sensors is failed, to initiate a first failsafe mode, inhibiting the first failsafe mode in response to the deceleration indicative signal from the vehicle-deceleration sensor during the first failsafe mode and holding the throttle valve at a predetermined default opening, to initiate a second failsafe mode, executing a diagnosis on abnormality in the unfailed throttle position sensor by comparing the sensor signal value from the unfailed throttle position sensor with a predetermined sensor-abnormality diagnostic criterion range during the second failsafe mode, determining that the unfailed throttle position sensor is operating abnormally when the sensor signal value from the unfailed throttle position sensor is out of the predetermined sensor-abnormality diagnostic criterion range, unconditionally continuing to hold the opening of the throttle valve at the predetermined default opening when the unfailed throttle position sensor is operating abnormally, setting the desired opening of the throttle valve based on a sensor signal value from an unfailed accelerator position sensor of the two accelerator position sensors at a single accelerator-position sensor failure mode where one of the two accelerator position sensors is failed, feedback-controlling the opening of the throttle valve by the desired opening based on the sensor signal value from the unfailed accelerator position sensor, to initiate a fourth failsafe mode, executing a diagnosis on abnormality in the unfailed accelerator position sensor by comparing the sensor signal value from the unfailed accelerator position sensor with a predetermined threshold value correlating with an idling condition of the engine during the fourth failsafe mode and during idling, determining that the unfailed accelerator position sensor is operating abnormally when the sensor signal value from the unfailed accelerator position sensor is above the predetermined threshold value, and unconditionally continuing to hold the opening of the throttle valve at the predetermined default opening when the unfailed accelerator position sensor is operating abnormally.

DESCRIPTION OF THE PREFERRED EMBODIMENTS

Figure 1:
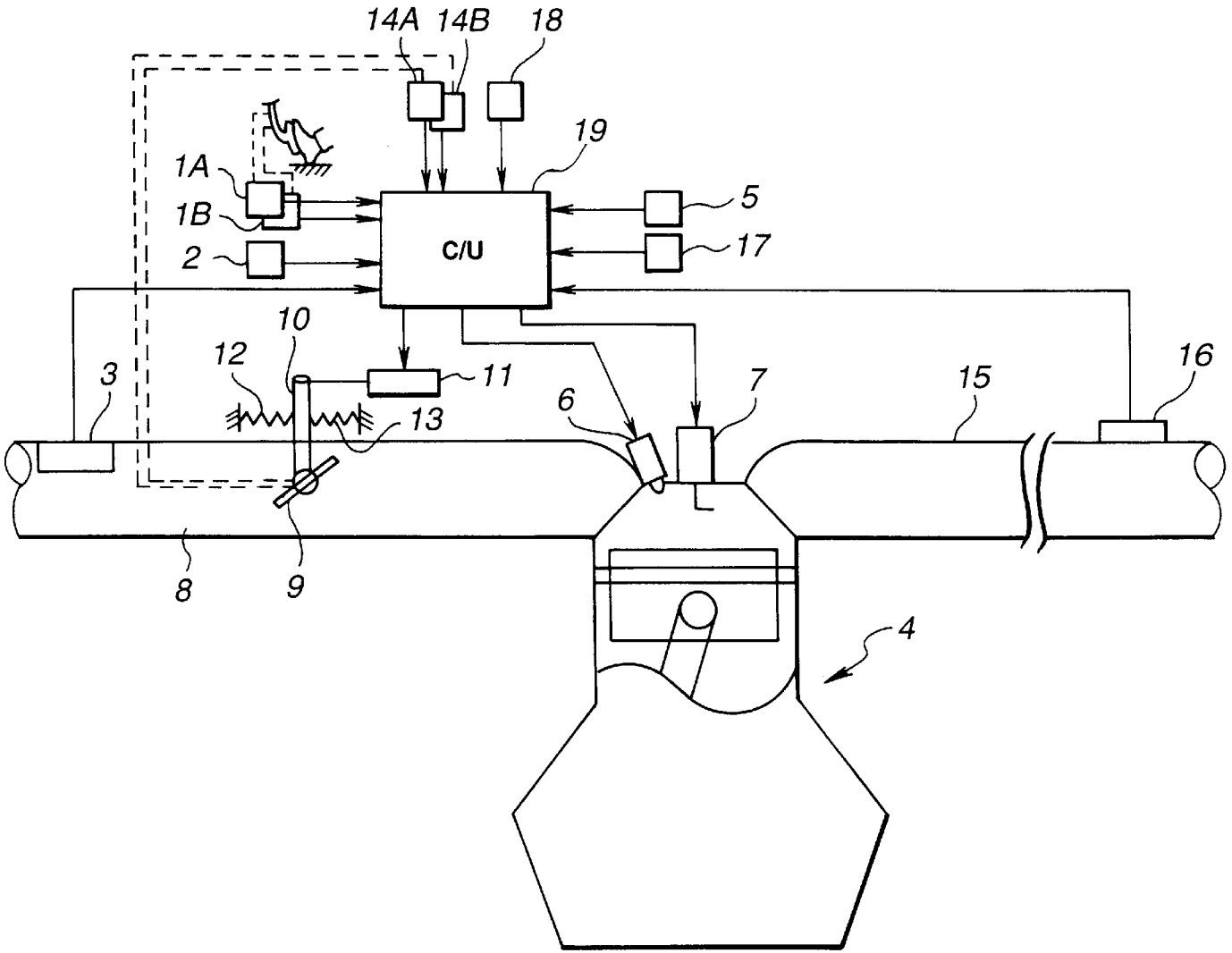
FIG. 1 is a system diagram illustrating one embodiment of a computer-controlled internal combustion engine with an electronically-controlled throttle system.

Referring now to the drawings, particularly to FIG. 1, the control apparatus of the invention is exemplified in an in-cylinder direct-injection spark-ignition internal combustion engine 4 equipped with an electronically-controlled throttle valve 9, a duplex throttle-position sensor system (or a duplex TPS sensor system 14A, 14B), and a duplex accelerator-position sensor system (a duplex APS sensor system 1A, 1B). As seen in FIG. 1, reference signs 1A and 1B denote two accelerator position sensors (two APS sensors) included in the duplex accelerator-position sensor system, each provided for detecting the amount of depression of the accelerator pedal. Although it is not clearly shown in FIG. 1, an accelerator wire (not shown) is connected between the accelerator pedal and an accelerator drum (not shown), and each of the accelerator position sensors 1A and 1B is connected to the accelerator drum on which part of the accelerator wire is wound. Thus, in the duplex accelerator-position sensor system, as the accelerator angle (the amount of depression of the accelerator pedal) is increased, the sensor signal (e. g. a voltage signal) from each of the accelerator-position sensors 1A and 1B increases. Reference sign 2 denotes a crank angle sensor. The crank angle sensor 2 is provided for detecting revolutions of the engine crankshaft or rotation of the camshaft. Assuming that the number of engine cylinders is "n", the crank angle sensor 2 generates a reference pulse signal REF at a predetermined crank angle for every crank angle 720°/n, and at the same time generates a unit pulse signal POS (1°) for every unit crank angle (1°). The central processing unit (CPU) of the ECU 19 arithmetically calculates or estimates engine speed on the basis of the period of the reference pulse signals REF and the unit pulse signals POS, while counting the number of generation of the POS signals per a unit time and/or monitoring the period between generations of the two adjacent reference signals. An air flow meter 3 is provided in the induction system downstream of an air cleaner (not shown) for detecting or measuring the actual volume of air flowing into the engine cylinders. The quantity of intake air supplied per a unit time is defined as an intake-airflow rate. An engine temperature sensor is located on the engine and usually screwed into one of the top coolant passages to detect or sense an actual operating temperature of the engine, (an engine temperature such as an engine coolant temperature). The electronic fuel injection system of the direct-injection spark-ignition engine includes an electromagnetic fuel-injection valve (simply an electromagnetic fuel injector) 6 provided at each engine cylinder, so that fuel (gasoline) can be injected or sprayed directly into each combustion chamber. The electronic ignition system of the direct-injection spark-ignition engine includes a spark plug 7 screwed into the cylinder head to ignite the air-fuel mixture. The direct-injection spark ignition engine uses at least two combustion modes, one being an early injection combustion mode (or a homogeneous combustion mode) where fuel-injection early in the intake stroke produces a homogeneous air-fuel mixture, and the other being a late injection combustion mode (or a stratified combustion mode) where late fuel-injection delays the event until near the end of the compression stroke to produce a stratified air-fuel mixture. During the homogeneous combustion mode, the early injection in the intake stroke enables the fuel spray to be diffused within the combustion chamber and then to be mixed more uniformly with the air. During the stratified combustion mode, the incoming air mixes with the denser fuel spray due to the late injection in the compression stroke, to create a rich mixture around the spark plug 7 for easy ignition, while the rest of the air-fuel mixture after late injection is very lean at edges of the combustion chamber. The electronic ignition system of the direct-injection spark-ignition engine 4 is responsive to an ignition signal from an electronic engine control unit (ECU or C/U) 19 or an electronic engine control module (ECM), for timely igniting the air-fuel mixture to ensure the homogeneous combustion on the intake stroke and to ensure the stratified combustion on the compression stroke. All air, entering the combustion chamber of each engine A cylinder of the engine 4, passes first through the air cleaner (not shown) and the air flow meter 3, flow via an intake-air passage 8 toward the electronically-controlled throttle valve 9. The electronically controlled throttle valve 9 is disposed in the intake-air passage 8 of the induction system, to electronically control the throttle opening (i.e., the flow rate of intake air entering each intake-valve port), arbitrarily depending on the engine/vehicle operating conditions (e.g., the amount of depression of an accelerator pedal or the like). For the throttle-opening adjustment, the electronically-controlled throttle valve 9 is actuated or operated by a throttle actuator 11 by virtue of a throttle operating lever 10. One end of the throttle operating lever 10 is fixedly connected to the throttle valve shaft of the throttle valve 9, whereas the other end of the throttle operating lever 10 is connected to the throttle actuator 11. As seen in FIG. 1, a return spring 12 and a default spring 13 are provided so that the spring bias of the return spring 12 is opposite to the spring bias of the default spring 13. The return spring 12 and the default spring 13 are connected respectively to left-hand and right-hand sides of the throttle operating lever 10, in such a way that the throttle valve 9 is held at its "default" opening (or "default" position) corresponding to a neutral position of the throttle operating lever 10 that spring biases caused by the return spring 12 and the default spring 13 are balanced to each other, when the throttle actuator 11 is de-energized. The electronically-controlled throttle valve 9, the throttle operating lever 10, the throttle actuator 11, the return spring 12, and the default spring 13 construct an electronically-controlled throttle system. Two throttle position sensors (two TPS sensors) 14A and 14B included in the duplex throttle-position sensor system are connected to the throttle valve shaft of the electronically-controlled throttle valve 9, for detecting an actual opening of the throttle valve 9. Usually, each of the throttle position sensors 14A and 14*b* is comprised of a variable resistor (a potentiometer) connected to the throttle valve shaft of the throttle valve 9, so that when the opening of the throttle valve 9 varies, a variable resistance voltage signal is sensed at the ECU 19. An air/fuel ratio (A/F ratio) sensor 16, such as 02 sensor, is located in an exhaust-gas passage 15 of the exhaust system (in either the engine exhaust manifold or piping) for monitoring the percentage of oxygen contained within engine exhaust gases at all times when the engine is running, so that the ECU 19 can maintain the A/F ratio at as close to stoichiometric as possible for complete fuel combustion and minimum exhaust emissions. Reference sign 17 denotes an idle switch (or an idle position switch) that is generally installed on the throttle body. The idle switch 17 is only energized when the throttle is at its closed position (or idle position). The position of the idle switch 17 provides a voltage signal to the ECU 19 so as to control fuel delivery pulse time of each of the fuel injectors 6 especially during deceleration or during idle speed. Reference sign 18 denotes a brake switch located near the brake pedal for detecting whether the brakes are applied or released. Each of the idle switch 17 and the brake switch 18 functions to detect a decelerating condition of the engine/vehicle. The input interface of the ECU 19 receives various sensor/switch signals from the accelerator position sensors 1A and 1B, the crank angle sensor 2, the air flow meter 3, the engine temperature sensor 5, the throttle position sensors 14A and 14B, the A/F ratio sensor 16 ($O_2$ sensor), the idle switch 17, and the brake switch 18. The ECU 19 determines a control signal value or a drive signal value for the throttle actuator 11 depending on the operating conditions estimated from the input informational signal data from these engine/vehicle sensors/switches, so as to output the determined control signal via its output interface to the throttle actuator 11 and to properly control the opening of the throttle valve 9. The output interface of the ECU 19 also generates a drive signal to each of the fuel injectors 6 to properly control the fuel injection amount (or the fuel delivery pulse time) as required. At the same time, the CPU of the ECU 19 arithmetically calculates or computes a desired ignition timing based on the input information from the previously-noted sensors/switches to perform a spark-timing control suitable to the operating conditions monitored.

Figure 2:
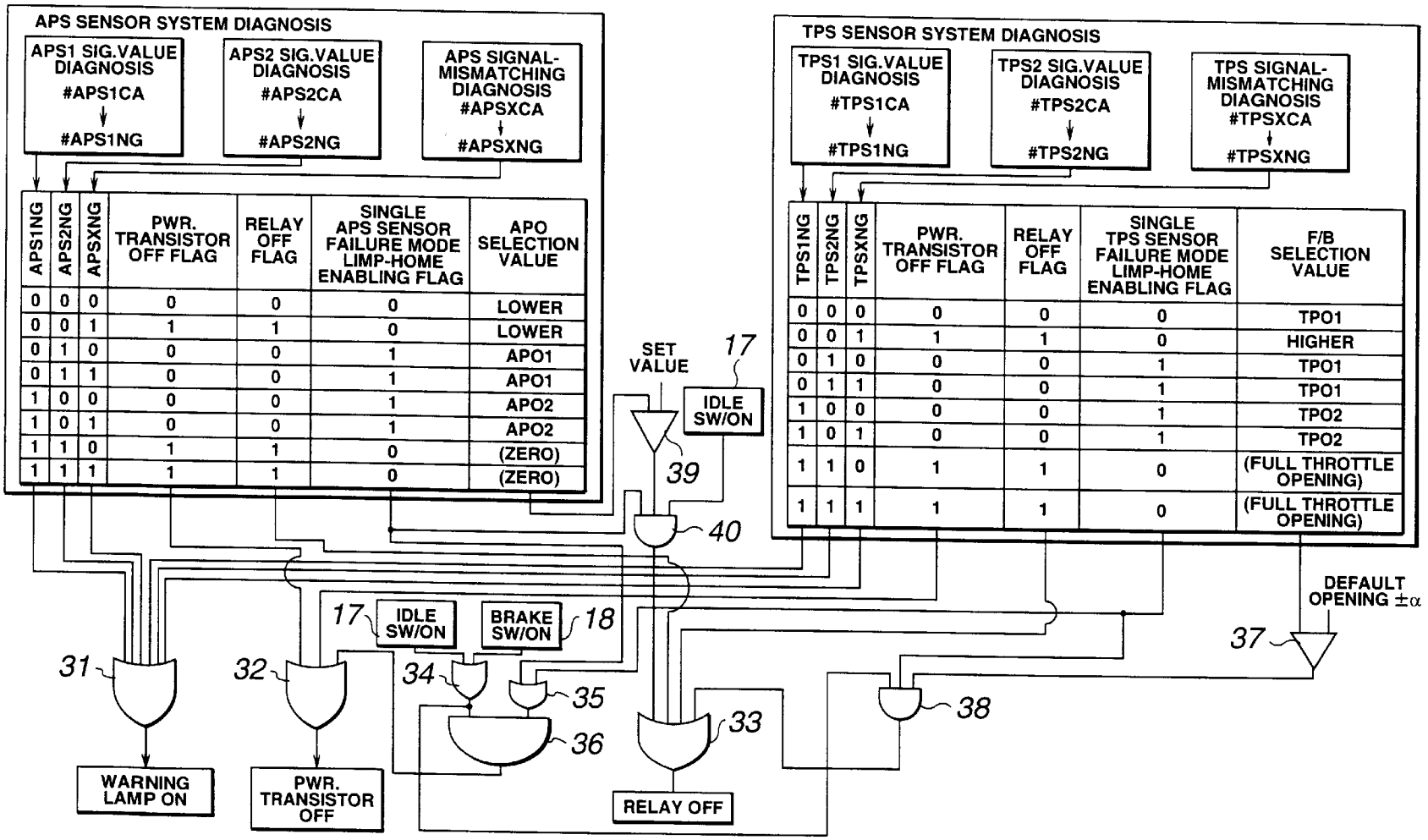
FIG. 2 is a logic circuit arrangement showing the relationship among diagnosis results of accelerator position sensors, diagnosis results of throttle position sensors, a switched-ON operation of a warning lamp, a turned-OFF operation of a power transistor, and a switched-OFF operation of a relay.

Referring now to FIG. 2, there is shown a sensor failure diagnosis plus fail-safe control routine executed by a failure-detection and failsafe system and based on the diagnosis results of the accelerator position sensors (1A, 1B) and the diagnosis results of the throttle position sensors (14A, 14B).

In FIG. 2, the left-hand half of the logic circuit arrangement corresponds to the accelerator-position sensor system failure diagnostic circuit, whereas the right-hand half of the logic circuit arrangement corresponds to the throttle-position sensor system failure diagnostic circuit. In the left-hand sensor failure diagnosis/detection circuit related to the accelerator-position sensor system, as seen from the leftmost block (APS1 sensor signal-value diagnosis block), a sensor failure detection is, first of all, made to determine whether an opened/shorted accelerator-position sensor circuit exists, on the basis of a shorted/opened input signal from the first accelerator position sensor 1A. When the first accelerator position sensor 1A (or APS1) is failed or when the shorted/opened signal from the first accelerator position sensor 1A (or APS1) occurs, a first accelerator-position sensor failure indicative flag APS1CA is set at "1". To eliminate a transient sensor failure, a further check is made to determine whether the sensor failure in the first accelerator position sensor 1A is continually detected for a predetermined delay time. In case that the failed-sensor state of the first accelerator position sensor 1A continues for the predetermined delay time, a first acceleration-position sensor failure decision flag APS1NG is set at "1". In the same manner, as seen from the center block (APS2 sensor signal-value diagnosis block), a sensor failure detection is made to check whether an opened/shorted accelerator-position sensor circuit exists, on the basis of a shorted/opened input signal from the second accelerator position sensor 1B. When the second accelerator position sensor 1B (or APS2) is failed or when the shorted/opened signal from the second accelerator position sensor 1B (or APS2) occurs, a second accelerator-position sensor failure indicative flag APS2CA is set at "1". When the failed-sensor state of the second accelerator position sensor 1B continues for the predetermined delay time, a second acceleration-position sensor failure decision flag APS2NG is set at "1". In this manner, the first accelerator-position sensor failure and the second accelerator-position sensor failure are detected and decided. In the sensor failure diagnosis plus fail-safe control sequence, the setting of each of the flags APS1CA, APS1NG, APS2CA, APS2NG, APSXCA, APSXNG, TPS1CA, TPS1NG, TPS2CA, TPS2NG, TPSXCA, TPSXNG, PWR.-TRANSISTOR OFF FLAG, RELAY OFF FLAG, and LIMP-HOME ENABLING FLAG means the output of a high-level voltage signal to each of circuits which will be fully described later, whereas the resetting of each of the same flags means the output of a low-level voltage signal to each of the circuits (described later). Additionally, as seen from the rightmost block (APS signal-mismatching diagnosis block), an APS signal-mismatching diagnosis is made to determine if there is the mismatching between values of two sensor signals from the two accelerator position sensors 1A and 1B of the duplex accelerator-position sensor system. In case that there is the signal mismatching between the values of sensor signals from the two accelerator position sensors 1A (or APS1) and 1B (or APS2), a signal-mismatching indicative flag APSXCA is set at "1". To eliminate a transient APS signal mismatching state, a further check is made to determine whether the signal mismatching state between the two accelerator position sensors (1A, 1B) continues for a predetermined delay time. In case that the signal mismatching state for the duplex APS sensor system continues for the predetermined delay time, an APS signal-mismatching state decision flag APSXNG is set at "1" in order to decide such a signal-mismatching state in the duplex accelerator-position sensor system.

Similarly to the above, in the right-hand sensor failure diagnosis/detection circuit related to the throttle-position sensor system, as seen from the leftmost block (TPS1 sensor signal-value diagnosis block) and the center block (TPS2 sensor signal-value diagnosis block), a check is made to determine whether an opened/shorted throttle-position sensor circuit exists, on the basis of shorted/opened input signals from the first and second throttle position sensor 14A and 14B. When the first throttle position sensor 14A (or TPS1) is failed or when the shorted/opened signal from the first throttle position sensor 14A (or TPS1) occurs, a first throttle-position sensor failure indicative flag TPS1CA is set at "1". A further check is made to determine whether the sensor failure in the first throttle position sensor 14A is continually detected for a predetermined delay time. In case that the failed-sensor state of the first throttle position sensor 14A continues for the predetermined delay time, a first throttle-position sensor failure decision flag TPS1NG is set at "1". In the same manner, a sensor failure detection is made to check whether an opened/shorted throttle-position sensor circuit exists, on the basis of a shorted/opened input signal from the second throttle position sensor 14B. When the second throttle position sensor 14B (or TPS2) is failed or when the shorted/opened signal from the second throttle position sensor 14B (or TPS2) occurs, a second throttle-position sensor failure indicative flag TPS2CA is set at "1". When the failed-sensor state of the second throttle position sensor 14B continues for the predetermined delay time, a second throttle-position sensor failure decision flag TPS2NG is set at "1". In this manner, the first throttle-position sensor failure and the second throttle-position sensor failure are detected and decided. In addition, as seen from the rightmost block (TPS signal-mismatching diagnosis block), a TPS signal-mismatching diagnosis is made to determine if there is the mismatching between values of two sensor signals from the two throttle position sensors 14A and 14B of the duplex throttle-position sensor system. In case that there is the signal mismatching between the values of sensor signals from the two throttle position sensors 14A (or TPS1) and 14B (or TPS2), a TPS signal-mismatching indicative flag TPSXCA is set at "1". To eliminate a transient TPS signal mismatching state, a further check is made to determine whether the signal mismatching state between the two throttle position sensors (14A, 14B) continues for a predetermined delay time. In case that the signal mismatching state for the duplex TPS sensor system continues for the predetermined delay time, a signal-mismatching state decision flag TPSXNG is set at "1" in order to decide such a signal-mismatching state in the duplex throttle-position sensor system.

In case that the first and second acceleration-position sensor failure decision flags APS1NG and APS2NG, and the APS signal-mismatching indicative flag APSXCA are all reset to "0" (see the first line from the top on the right-hand side APS sensor system diagnosis table of FIG. 2), that is, when all of the accelerator-position sensor circuits of the APS sensor system are operating normally, the ECU 19 selects a lower one of the sensor signal values from the two accelerator position sensors 1A and 1B by way of a so-called select-LOW process. The select-LOW process for selection of an accelerator-pedal opening (APO) is effective to prevent excessive engine power output. In other words., a selection value (an APO selection value) of the accelerator-pedal opening (APO) is set at a lower one (LOWER) of the two APS sensor signal values. On the other hand, in case that the first and second throttle-position sensor failure decision f-lags TPS1NG and TPS2NG, and the TPS signal-mismatching indicative flag TPSXCA are all reset to "0" (see the first line from the top on the right-hand side TPS sensor system diagnosis table of FIG. 2), that is, when all of the throttle-position sensor circuits of the TPS sensor system are operating normally, the ECU 19 uses a throttle-opening indicative first-sensor signal value TPO1 from the main throttle position sensor (the first throttle position sensor 14A). When the central processing unit (CPU) of the ECU 19 decides on the basis of the diagnosis results (APS1NG=0, APS2NG=0, APSXNG=0, TPS1NG=0, TPS2NG=0, TPSXNG=0) that the APS sensor system and the TPS sensor system are both operating normally, the ECU 19 simultaneously decides that there is no necessity for setting of a so-called "limp-home" mode. Thus, a single APS sensor failure mode limp-home enabling flag and a single TPS sensor failure mode limp-home enabling flag are both reset to "0". At the same time, a power-transistor OFF flag and a relay OFF flag are both reset to "0". In such a case that the duplex APS sensor system and the duplex TPS sensor system are both operating normally, an output voltage signal at a second OR gate circuit 32 becomes a low level and an output voltage signal at a third OR gate circuit 33 becomes a low level, with the result that a power transistor and a relay, which is used to drive or operate the throttle actuator 11, are both turned ON. In this case, the throttle actuator 11 is driven, so that the opening of the electronically-controlled throttle valve 9 is adjusted or controlled toward a desired throttle opening that is set or determined on the basis of the "LOWER" selection value of the two APS sensor values. At this time, the flags APS1NG, APS2NG, APSXNG, TPS1NG, TPS2NG, and TPSXNG are all reset, and thus an output voltage signal at a first OR gate circuit 31 is also maintained at a low level. As a result, a warning lamp, which is used for indication of a sensor failure, does not come ON.

In case that only the signal-mismatching indicative flag (APSXCA and/or TPSXCA) in at least one of the duplex APS sensor system and the duplex TPS sensor system is set at "1" (see the second line from the top on each of the left-hand APS sensor system diagnosis table and the right-hand TPS sensor system diagnosis table shown in FIG. 2), the ECU 19 determines that the signal values from both of the accelerator position sensors 1A and 1B are not reliable and/or the signal values from both the throttle position sensors 14A and 14B are not reliable. In this case, the power-transistor OFF flag and the relay OFF flag are both set at "1", the output voltage signal at the first OR gate circuit 31 becomes a high level. As a result, the warning light comes ON. The outputs from the second and third OR gate circuits 32 and 33 become high levels, with the result that the power transistor and the relay, serving to drive the throttle actuator 11, are both turned OFF, thus de-energizing the throttle actuator. As a consequence, a F/B selection value, which is used for feedback control for the opening of the electronically-controlled throttle valve 9, is first (temporarily) set at a higher one (HIGHER) of the sensor signals from the two throttle position sensors 14A (TPS1) and 14B (TPS2) by way of a so-called select-HIGH process, and thereafter the throttle valve 9 is controlled toward the "default" opening and then maintained at the "default" opening. The vehicle can run, therefore, at the minimum necessary speed such as 40 Km/h. As may be appreciated, if there is a "1" or a high-level input voltage signal at either input terminal of the first OR gate circuit 31, the OR gate circuit 31 outputs a high-level voltage signal, so as to illuminate the warning lamp.

In case that either one of the first and second acceleration-position sensor failure decision flags APS1NG and APS2NG is set at "1", that is, when the sensor failure of either one of the accelerator-position sensors 1A and 1B is detected (see the third to sixth lines from the top on the left-hand side APS sensor system diagnosis table of FIG. 2), a single APS sensor failure mode limp-home enabling flag is set at "1", the power-transistor OFF flag and the relay OFF flag are both reset to "0". In case of such a single APS sensor failure, as can be seen from the rightmost column indicating the APS selection value, in setting or estimating the throttle opening of the throttle valve 9, the ECU 19 uses or selects the sensor signal value (APO1 or APO2) of the unfailed APS sensor. For example, in presence of the second APS sensor failure, that is, in case of APS1NG=0 and APS2NG=1 (see the third and fourth lines from the top on the left-hand side APS sensor system diagnosis table of FIG. 2), the accelerator-opening indicative signal value APO1 of the first APS sensor is selected as the APO selection value. Conversely, in presence of the first APS sensor failure, that is, in case of APS1NG=1 and APS2NG=0 (see the fifth and sixth lines from the top on the left-hand side APS sensor system diagnosis table of FIG. 2), the accelerator-opening indicative signal value APO2 of the second APS sensor is selected as the APO selection value. Likewise, in case that either one of the first and second throttle-position sensor failure decision flags TPS1NG and TPS2NG is set at "1", that is, when the sensor failure of either one of the throttle position sensors 14A and 14B is detected (see the third to sixth lines from the top on the right-hand side TPS sensor system diagnosis table of FIG. 2), a single TPS sensor failure mode limp-home enabling flag is set at "1", the power-transistor OFF flag and the relay OFF flag are both reset to "0". In case of such a single TPS sensor failure, as can be seen from the rightmost column indicating the TPS selection value, in setting or estimating the throttle opening of the throttle valve 9, the ECU 19 uses or selects the sensor signal value (TPO1 or TPO2) of the unfailed TPS sensor. For example, in presence of the second TPS sensor failure, that is, in case of TPS1NG=0 and TPS2NG=1 (see the third and fourth lines from the top on the right-hand side TPS sensor system diagnosis table of FIG. 2), the throttle-opening indicative signal value TPO1 of the first TPS sensor is selected as the F/B selection value. Conversely, in presence of the first TPS sensor failure, that is, in case of TPS1NG=1 and TPS2NG=0 (see the fifth and sixth lines from the top on the right-hand side TPS sensor system diagnosis table of FIG. 2), the throttle-opening indicative signal value TPO2 of the second TPS sensor is selected as the F/B selection value. As discussed above, in case that a single sensor failure occurs in either one of the APS sensor system (1A, 1B) and the TPS sensor system (14A, 14B), and also in case that a single sensor failure occurs in each of the APS sensor system and the TPS sensor system, usually (without any decelerating condition of the vehicle), the throttle actuator 11 is driven so that the opening of the electronically-controlled throttle valve 9 is adjusted or controlled toward a desired throttle opening based on the APO selection value (the sensor signal value of the unfailed APS sensor). The selection of the sensor signal value of the unfailed sensor is effective to prevent the opening of the throttle valve 9 from being forcibly maintained at the "default" opening, thus avoiding the vehicle speed from being limited to a low speed such as 40 Km/h. In other words, by the use of the sensor signal value of the unfailed sensor, the vehicle can run at a desired speed even in the case of the single sensor failure in either one of the APS and TPS sensor systems or in both of the APS and TPS sensor systems. However, in the case of the previously-noted single sensor failure (the single APS sensor failure and/or the single TPS sensor failure), and additionally when a decelerating operation is made according to the driver's wishes, for example, when the accelerator pedal is released and thus the idle switch 17 is switched ON, and/or when the brakes are applied and thus the brake switch 18 is switched ON, an output voltage signal at a fourth OR gate circuit 34 becomes a high level. Owing to the presence of the single sensor failure in at least one of the APS and TPS sensor systems, at least one of the single APS sensor failure mode limp-home enabling flag and the single TPS sensor failure mode limp-home enabling flag is set at "1". Thus, an output voltage signal at a fifth OR gate circuit 35 becomes a high level. Since the outputs of the fourth and fifth OR gate circuits 34 and 35 are both high or 1, an output voltage signal at a first AND gate circuit 36 becomes high or 1. As a result, the second OR gate circuit 32 becomes high or 1, and therefore the throttle-actuator driving power transistor is turned OFF to de-energize the throttle actuator 11, thus holding the throttle valve 9 at the "default" opening. In other words, with the single APS sensor failure mode limp-home enabling flag set and/or the single TPS sensor failure mode limp-home enabling flag set, the ECU 19 performs the limp-home mode or the limp-in mode which allows the engine/vehicle to be run/driven but with greatly reduced performance (for example, a fixed limp-in speed of approximately 40 Km/h).

In case of the double sensor failure in the APS sensor system (1A, 1B), that is, when the two APS sensors are both failed (the presence of shorted/opened signals from both the first and second APS sensors 1A and 1B), or in case of the double sensor failure in the TPS sensor system (14A, 14B), that is, when the two TPS sensors are both failed (the presence of shorted/opened signals from both the first and second TPS sensors 14A and 14B), the ECU 19 determines that the signal values from both the accelerator position sensors 1A and 1B are not reliable and/or the signal values from both the throttle position sensors 14A and 14B are not reliable. Thus, the ECU 19 temporarily sets the APO selection value at a "0" signal value in the presence of the double sensor failure in the APS sensor system, and thereafter sets both of the power-transistor OFF flag and the relay OFF flag at "1", to de-energize the throttle actuator 11 and then to hold the throttle 9 at the "default" opening. In the presence of the double sensor failure in the TPS sensor system, the ECU 19 temporarily set the F/B selection value at a full-throttle opening, and thereafter sets both of the power-transistor OFF flag and the relay OFF flag at "1", to de-energize the throttle actuator 11 and to smoothly quickly feedback-control the throttle valve 9 in a direction decreasing the throttle opening, so that the throttle opening is adjusted to the "default" opening. In this manner, the opening of the electronically-controlled throttle valve 9 is held at the "default" opening.

Hereunder described in detail is the fail-safe control procedures performed when the unfailed APS sensor of the duplex APS sensor system changes from normal to abnormal under a particular condition where only one of the two APS sensors 1A and 1B is failed or when the unfailed TPS sensor of the duplex TPS sensor system changes from normal to abnormal under a particular condition where only one of the two TPS sensors 14A and 14B is failed. Note that the term "abnormal" means remarkable mismatching between a sensor signal value from the unfailed APS sensor (the unfailed TPS sensor) and a predetermined sensor-abnormality diagnostic criterion range or a predetermined threshold (a predetermined sensor-abnormality diagnostic criterion). The predetermined sensor-abnormality diagnostic criterion range or the predetermined threshold is preprogrammed under a specified condition, for example during a decelerating condition of the vehicle or during idling. The term "abnormal" never means a shorted/opened signal. The fail-safe control related to the duplex TPS sensor system (14A, 14B) is hereinafter described in detail.

In case that the decelerating operation is made by the driver at the single TPS sensor failure mode where one of the two throttle position sensors 14A and 14B is failed and thus the throttle-opening feedback control for the electronically-controlled throttle valve 9 is executed on the basis of the sensor signal from the other throttle position sensor (the unfailed throttle-position sensor), the idle switch 17 becomes energized (ON) with the accelerator pedal released and/or the brake switch 18 becomes energized (ON) with depression of the brake pedal. In such a decelerating condition of the vehicle, the power transistor is turned OFF, to switch the throttle actuator 11 from an operative state to an in-operative state. With the throttle actuator 11 in the in-operative, during the vehicle deceleration, the throttle valve 9 is usually controlled toward its "default" opening, and then held at the "default" opening. Under such a specified condition that the throttle valve 9 is maintained at the "default" opening during the engine/vehicle deceleration at the single TPS sensor failure mode, a sensor signal value from the unfailed TPS sensor is compared with a predetermined sensor-abnormality diagnostic criterion range, namely an upper limit (a "default" opening plus $\alpha$) and a lower limit (a "default" opening minus $\alpha$) by means of a window comparator 37 whose output is determined by way of a window function. The upper limit of the predetermined sensor-abnormality diagnostic criterion range is obtained by adding a predetermined margin $\alpha$ to the "default" opening, whereas the lower limit of the predetermined sensor-abnormality diagnostic criterion range is obtained by subtracting a predetermined margin from the "default" opening. When the sensor signal value from the unfailed TPS sensor is not within the sensor-abnormality diagnostic criterion range, that is, when the unfailed TPS sensor signal value is above the "default" opening plus $\alpha$ or when the unfailed TPS sensor signal value is below the "default" opening minus $\alpha$, the ECU 19 determines that the unfailed TPS sensor is operating abnormally, and thus the relay for the throttle actuator 11 is turned OFF. The window comparator 37 is designed, so that its output voltage signal becomes high (or 1) when the condition defined by a predetermined inequality (the sensor signal value from the unfailed TPS sensor>the "default" opening plus a ) is satisfied or when the condition defined by a predetermined inequality (the sensor signal value from the unfailed TPS sensor<the "default" opening minus α) is satisfied. For the purpose of fail-safe in presence of transition of the unfailed TPS sensor from normal to abnormal at the single TPS sensor failure mode, a second AND gate circuit 38 is provided in such a way that its input terminals receive the output signal from the window comparator 37, the input data from the single TPS sensor failure mode limp-home enabling flag terminal, and the output signal from the fourth OR gate circuit 34, and its output signal is fed into the third OR gate circuit 33. With the previously-noted arrangement for the failsafe purpose in the duplex TPS sensor system, when the state of the unfailed TPS sensor changes from normal to abnormal during the vehicle deceleration at the single TPS sensor failure mode, the second AND gate circuit 38 receives high-level voltage signals from all of the window comparator 37, the single TPS sensor failure mode limp-home enabling flag line, and the fourth OR gate circuit 34. Under these conditions, the output voltage signal at the second AND gate circuit 38 becomes high (or 1), and thus the output voltage signal at the third OR gate circuit 33 becomes high (or 1). As a result, the throttle-actuator relay is turned OFF. In this manner, if the ECU 19 once determines that the unfailed TPS sensor is operating abnormally in the single TPS sensor failure mode, the throttle-actuator relay remains kept OFF. Even if the accelerator pedal is depressed by the driver after the decision of abnormality in the unfailed TPS sensor during the single TPS sensor failure mode, the throttle actuator 11 is de-energized unconditionally and thus the opening of throttle valve 9 is maintained at its "default" opening, so that the ECU 19 performs the limp-home mode which allows the engine/vehicle to be run/driven but with greatly reduced performance (for example, a fixed limp-in speed of approximately 40 Km/h). As discussed above, the fail-safe control apparatus of the embodiment can enhance a reliability of fail-safe control in the duplex throttle-position sensor system.

The fail-safe control related to the duplex APS sensor system (1A, 1B) is as follows.

In case that the idle switch 17 becomes energized (ON) with the accelerator pedal released at the single APS sensor failure mode where one of the two accelerator position sensors 1A and 1B is failed and thus a desired opening of the electronically-controlled throttle valve 9 is set or determined on the basis of the sensor signal from the other accelerator position sensor (the unfailed accelerator position sensor), a sensor signal value from the unfailed APS sensor is compared with a predetermined or preprogrammed threshold value (simply a set value) correlating with a usual accelerator pedal opening given during idling of the engine, by means of a comparator 39. Actually, if the sensor signal value from the unfailed APS sensor is above the predetermined threshold value, then the output voltage signal from the comparator would be a high output signal level (or 1). At this time, the ECU 19 determines that the unfailed APS sensor is operating abnormally, and thus the throttle-actuator relay is turned OFF. For the purpose of fail-safe in presence of transition of the unfailed APS sensor from normal to abnormal at the single APS sensor failure mode, a third AND gate circuit 40 is provided in such a way that its input terminals receive the output signal from the comparator 39, the input data from the single APS sensor failure mode limp-home enabling flag terminal, and the output signal from the idle switch 17, and its output signal is fed into the third OR gate circuit 33. With the previously-noted arrangement for the failsafe purpose in the duplex APS sensor system, when the state of the unfailed APS sensor changes from normal to abnormal during the idling period at the single APS sensor failure mode, the third AND gate circuit 40 receives high-level voltage signals from all of the comparator 39, the idle switch 17, and the single APS sensor failure mode limp-home enabling flag line. Under these conditions, the output voltage signal at the third AND gate circuit 40 becomes high (or 1), and thus the output voltage signal at the third OR gate circuit 33 also becomes high (or 1). As a result, the throttle-actuator relay is turned OFF. In this manner, if the ECU 19 once determines that the unfailed APS sensor is operating abnormally in the single APS sensor failure mode, the throttle-actuator relay remains kept OFF. As appreciated from the above, after the decision of abnormality in the unfailed APS sensor during the single APS sensor failure mode, the throttle actuator 11 is de-energized unconditionally and thus the opening of throttle valve 9 is maintained at its "default" opening, so that the ECU 19 performs the limp-home mode which allows the engine/vehicle to be run/driven but with greatly reduced performance (for example, a fixed limp-in speed of approximately 40 Km/h). The fail-safe control apparatus of the embodiment can also enhance a reliability of fail-safe control in the duplex accelerator-position sensor system.

The entire contents of Japanese Patent Application No. P10-244114 (filed Aug. 28, 1998) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A control apparatus for an internal combustion engine with an electronically-controlled throttle system having a throttle valve disposed in an induction system and an actuator operating the throttle valve so that an opening of the throttle valve is adjusted to a desired opening, comprising:

a duplex throttle-position sensor system having two throttle position sensors each detecting the opening of the throttle valve;

a vehicle-deceleration sensor detecting a decelerating condition of the engine and generating a deceleration indicative signal; and a fail-safe system configured to be electronically connected to the two throttle position sensors and the vehicle-deceleration sensor for responding to a failure in at least one of the two throttle position sensors for failsafe purposes; said fail-safe system comprising (1) a first failsafe section which controls the opening of the throttle valve by a sensor signal value from an unfailed throttle position sensor of the two throttle position sensors at a single throttle-position sensor failure mode where one of the two throttle position sensors is failed, to initiate a first failsafe mode, (2) a second failsafe section which inhibits the first failsafe mode in response to the deceleration indicative signal from said vehicle-deceleration sensor during the first failsafe mode and holds the throttle valve at a predetermined default opening, to initiate a second failsafe mode, and (3) a third failsafe section which detects if the sensor signal value from the unfailed throttle position sensor is within a predetermined sensor-abnormality diagnostic criterion range during the second failsafe mode, and unconditionally continues to hold the opening of the throttle valve at the predetermined default opening when the sensor signal value from the unfailed throttle position sensor is out of the predetermined sensor-abnormality diagnostic criterion range.

2. The control apparatus as claimed in claim 1, wherein the predetermined sensor-abnormality diagnostic criterion range is defined in such a way that an upper limit of the predetermined sensor-abnormality diagnostic criterion range is obtained by adding a predetermined margin to the predetermined default opening and a lower limit of the predetermined sensor-abnormality diagnostic criterion range is obtained by subtracting the predetermined margin from the predetermined default opening.

3. The control apparatus as claimed in claim 1, wherein said vehicle-deceleration sensor comprises an idle switch which detects an idling condition of the engine.

4. The control apparatus as claimed in claim 1, wherein said vehicle-deceleration sensor comprises a brake switch which detects if brakes are applied or released.

5. The control apparatus as claimed in claim 1, wherein the electronically-controlled throttle system comprises a throttle operating lever whose ends are connected respectively to a throttle shaft of the throttle valve and the actuator, and a return spring and a default spring connected to respective sides of the throttle operating lever so that a biasing force of the return spring is opposite to a biasing force of the default spring, and wherein the predetermined default opening is set as a neutral position of the throttle operating lever that the biasing force of the return spring and the biasing force of the default spring are balanced to each other under a condition where the actuator is de-energized.

6. A control apparatus for an internal combustion engine with an electronically-controlled throttle system having a throttle valve disposed in an induction system and an actuator operating the throttle valve so that an opening of the throttle valve is adjusted to a desired opening, comprising:

a duplex throttle-position sensor system having two throttle position sensors each detecting the opening of the throttle valve;

a duplex accelerator-position sensor system having two accelerator position sensors each detecting an amount of depression of an accelerator pedal;

a vehicle-deceleration sensor detecting a decelerating condition of the engine and generating a deceleration indicative signal; and a fail-safe system configured to be electronically connected to the two throttle position sensors, the two accelerator position sensors and the vehicle deceleration sensor for responding to a failure in at least one of the two throttle position sensors and the two accelerator position sensors for failsafe purposes; said fail-safe system comprising (1) a first failsafe section which feedback-controls the opening of the throttle valve by a sensor signal value from an unfailed throttle position sensor of the two throttle position sensors at a single throttle-position sensor failure mode where one of the two throttle position sensors is failed, to initiate a first failsafe mode, (2) a second failsafe section which inhibits the first failsafe mode in response to the deceleration indicative signal from said vehicle-deceleration sensor during the first failsafe mode and holds the throttle valve at a predetermined default opening, to initiate a second failsafe mode, (3) a third failsafe section which detects if the sensor signal value from the unfailed throttle position sensor is within a predetermined sensor-abnormality diagnostic criterion range during the second failsafe mode, and unconditionally continues to hold the opening of the throttle valve at the predetermined default opening when the sensor signal value from the unfailed throttle position sensor is out of the predetermined sensor-abnormality diagnostic criterion range, (4) a fourth failsafe section which sets the desired opening of the throttle valve based on a sensor signal value from an unfailed accelerator position sensor of the two accelerator position sensors at a single accelerator-position sensor failure mode where one of the two accelerator position sensors is failed and feedback-controls the opening of the throttle valve by the desired opening based on the sensor signal value from the unfailed accelerator position sensor, to initiate a fourth failsafe mode, and (5) a fifth failsafe section which detects if the sensor signal value from the unfailed accelerator position sensor is above a predetermined threshold value correlating with an idling condition of the engine during the fourth failsafe mode and during idling, and unconditionally continues to hold the opening of the throttle valve at the predetermined default opening when the sensor signal value from the unfailed accelerator position sensor is above the predetermined threshold value.

7. The control apparatus as claimed in claim 6, wherein said second failsafe section inhibits the fourth failsafe mode in response to the deceleration indicative signal from said vehicle-deceleration sensor during the fourth failsafe mode and holds the throttle valve at the predetermined default opening.

8. In a computer-controlled internal combustion engine with an electronically-controlled throttle system having a throttle valve disposed in an induction system and an actuator operating the throttle valve so that an opening of the throttle valve is adjusted to a desired opening, a duplex throttle-position sensor system having two throttle position sensors each detecting the opening of the throttle valve, a vehicle-deceleration sensor detecting a decelerating condition of the engine and generating a deceleration indicative signal, and a sensor-failure detection and fail-safe system configured to be electronically connected to the two throttle position sensors and the vehicle-deceleration sensor for responding to a failure in at least one of the two throttle position sensors for failsafe purposes, comprising:

(1) a first failsafe means for feedback-controlling the opening of the throttle valve by a sensor signal value from an unfailed throttle position sensor of the two throttle position sensors at a single throttle-position sensor failure mode where one of the two throttle position sensors is failed, to initiate a first failsafe mode, (2) a second failsafe means for inhibiting the first failsafe mode in response to the deceleration indicative signal from said vehicle-deceleration sensor during the first failsafe mode and holding the throttle valve at a predetermined default opening, to initiate a second failsafe mode, and (3) a third failsafe means having a window comparator for executing a diagnosis on abnormality in the unfailed throttle position sensor by comparing the sensor signal value from the unfailed throttle position sensor with a predetermined sensor-abnormality diagnostic criterion range during the second failsafe mode, and determining that the unfailed throttle position sensor is operating abnormally when the sensor signal value from the unfailed throttle position sensor is out of the predetermined sensor-abnormality diagnostic criterion range, and unconditionally continuing to hold the opening of the throttle valve at the predetermined default opening when the unfailed throttle position sensor is operating abnormally.

9. The sensor-failure detection and fail-safe system as claimed in claim 8, wherein the predetermined sensor-abnormality diagnostic criterion range is defined in such a way that an upper limit of the predetermined sensor-abnormality diagnostic criterion range is obtained by adding a predetermined margin to the predetermined default opening and a lower limit of the predetermined sensor-abnormality diagnostic criterion range is obtained by subtracting the predetermined margin from the predetermined default opening.

10. The sensor-failure detection and fail-safe system as claimed in claim 8, wherein said vehicle-deceleration sensor comprises an idle switch which detects an idling condition of the engine.

11. The sensor-failure detection and fail-safe system as claimed in claim 8, wherein said vehicle-deceleration sensor comprises a brake switch which detects if brakes are applied or released.

12. The sensor-failure detection and fail-safe system as claimed in claim 8, wherein the electronically-controlled throttle system comprises a throttle operating lever whose ends are connected respectively to a throttle shaft of the throttle valve and the actuator, and a return spring and a default spring connected to respective sides of the throttle operating lever so that a biasing force of the return spring is opposite to a biasing force of the default spring, and wherein the predetermined default opening is set as a neutral position of the throttle operating lever that the biasing force of the return spring and the biasing force of the default spring are balanced to each other under a condition where the actuator is de-energized.

13. In a computer-controlled internal combustion engine with an electronically-controlled throttle system having a throttle valve disposed in an induction system and an actuator operating the throttle valve so that an opening of the throttle valve is adjusted to a desired opening, a duplex throttle-position sensor system having two throttle position sensors each detecting the opening of the throttle valve, a duplex accelerator-position sensor system having two accelerator position sensors each detecting an amount of depression of an accelerator pedal, a vehicle-deceleration sensor detecting a decelerating condition of the engine and generating a deceleration indicative signal, and a sensor-failure detection and fail-safe system configured to be electronically connected to the two throttle position sensors, the two accelerator position sensors and the vehicle-deceleration sensor for responding to a failure in-at least one of the two throttle position sensors and the two accelerator position sensors for failsafe purposes, comprising:

(1) a first failsafe means for feedback-controlling the opening of the throttle valve by a sensor signal value from an unfailed throttle position sensor of the two throttle position sensors at a single throttle-position sensor failure mode where one of the two throttle position sensors is failed, to initiate a first failsafe mode, (2) a second failsafe means for inhibiting the first failsafe mode in response to the deceleration indicative signal from said vehicle-deceleration sensor during the first failsafe mode and holding the throttle valve at a predetermined default opening, to initiate a second failsafe mode, (3) a third failsafe means having a window comparator for executing a diagnosis on abnormality in the unfailed throttle position sensor by comparing the sensor signal value from the unfailed throttle position sensor with a predetermined sensor-abnormality diagnostic criterion range during the second failsafe mode, and determining that the unfailed throttle position sensor is operating abnormally when the sensor signal value from the unfailed throttle position sensor is out of the predetermined sensor-abnormality diagnostic criterion range, and unconditionally continuing to hold the opening of the throttle valve at the predetermined default opening when the unfailed throttle position sensor is operating abnormally, (4) a fourth failsafe means for setting the desired opening of the throttle valve based on a sensor signal value from an unfailed accelerator position sensor of the two accelerator position sensors at a single accelerator-position sensor failure mode where one of the two accelerator position sensors is failed and feedback-controlling the opening of the throttle valve by the desired opening based on the sensor signal value from the unfailed accelerator position sensor, to initiate a fourth failsafe mode, and (5) a fifth failsafe means having a comparator for executing a diagnosis on abnormality in the unfailed accelerator position sensor by comparing the sensor signal value from the unfailed accelerator position sensor with a predetermined threshold value correlating with an idling condition of the engine during the fourth failsafe mode and during idling, and determining that the unfailed accelerator position sensor is operating abnormally when the sensor signal value from the unfailed accelerator position sensor is above the predetermined threshold value, and unconditionally continuing to hold the opening of the throttle valve at the predetermined default opening when the unfailed accelerator position sensor is operating abnormally.

14. The sensor-failure detection and fail-safe system as claimed in claim 13, wherein said second failsafe means inhibits the fourth failsafe mode in response to the deceleration indicative signal from said vehicle-deceleration sensor during the fourth failsafe mode and holds the throttle valve at the predetermined default opening.

15. A method for executing failsafe functions for a computer-controlled internal combustion engine with an electronically-controlled throttle system having a throttle valve disposed in an induction system and an actuator operating the throttle valve so that an opening of the throttle valve is adjusted to a desired opening, a duplex throttle-position sensor system having two throttle position sensors each detecting the opening of the throttle valve, a vehicle-deceleration sensor detecting a decelerating condition of the engine and generating a deceleration indicative signal, and a sensor-failure detection and fail-safe system configured to be electronically connected to the two throttle position sensors and the vehicle-deceleration sensor for responding to a failure in at least one of the two throttle position sensors for failsafe purposes, the method comprising:

feedback-controlling the opening of the throttle valve by a sensor signal value from an unfailed throttle position sensor of the two throttle position sensors at a single throttle-position sensor failure mode where one of the two throttle position sensors is failed, to initiate a first failsafe mode;

inhibiting the first failsafe mode in response to the deceleration indicative signal from said vehicle-deceleration sensor during the first failsafe mode and holding the throttle valve at a predetermined default opening, to initiate a second failsafe mode;

executing a diagnosis on abnormality in the unfailed throttle position sensor by comparing the sensor signal value from the unfailed throttle position sensor with a predetermined sensor-abnormality diagnostic criterion range during the second failsafe mode;

determining that the unfailed throttle position sensor is operating abnormally when the sensor signal value from the unfailed throttle position sensor is out of the predetermined sensor-abnormality diagnostic criterion range; and unconditionally continuing to hold the opening of the throttle valve at the predetermined default opening when the unfailed throttle position sensor is operating abnormally.

16. The method as claimed in claim 15, wherein the predetermined sensor-abnormality diagnostic criterion range is defined in such a way that an upper limit of the predetermined sensor-abnormality diagnostic criterion range is obtained by adding a predetermined margin to the predetermined default opening and a lower limit of the predetermined sensor-abnormality diagnostic criterion range is obtained by subtracting the predetermined margin from the predetermined default opening.

17. The method as claimed in claim 15, wherein said vehicle-deceleration sensor comprises an idle switch which detects an idling condition of the engine.

18. The method as claimed in claim 15, wherein said vehicle-deceleration sensor comprises a brake switch which detects if brakes are applied or released.

19. The method as claimed in claim 15, wherein the electronically-controlled throttle system comprises a throttle operating lever whose ends are connected respectively to a throttle shaft of the throttle valve and the actuator, and a return spring and a default spring connected to respective sides of the throttle operating lever so that a biasing force of the return spring is opposite to a biasing force of the default spring, and wherein the predetermined default opening is set as a neutral position of the throttle operating lever that the biasing force of the return spring and the biasing force of the default spring are balanced to each other under a condition where the actuator is de-energized.

20. A method for executing failsafe functions for a computer-controlled internal combustion engine with an electronically-controlled throttle system having a throttle valve disposed in an induction system and an actuator operating the throttle valve so that an opening of the throttle valve is adjusted to a desired opening, a duplex throttle-position sensor system having two throttle position sensors each detecting the opening of the throttle valve, a duplex accelerator-position sensor system having two accelerator position sensors each detecting an amount of depression of an accelerator pedal, a vehicle-deceleration sensor detecting a decelerating condition of the engine and generating a deceleration indicative signal, and a sensor-failure detection and fail-safe system configured to be electronically connected to the two throttle position sensors, the two accelerator position sensors and the vehicle-deceleration sensor for responding to a failure in at least one of the two throttle position sensors and the two accelerator position sensors for failsafe purposes, the method comprising:

feedback-controlling the opening of the throttle valve by a sensor signal value from an unfailed throttle position sensor of the two throttle position sensors at a single throttle-position sensor failure mode where one of the two throttle position sensors is failed, to initiate a first failsafe mode;

inhibiting the first failsafe mode in response to the deceleration indicative signal from said vehicle-deceleration sensor during the first failsafe mode and holding the throttle valve at a predetermined default opening, to initiate a second failsafe mode;

executing a diagnosis on abnormality in the unfailed throttle position sensor by comparing the sensor signal value from the unfailed throttle position sensor with a predetermined sensor-abnormality diagnostic criterion range during the second failsafe mode;

determining that the unfailed throttle position sensor is operating abnormally when the sensor signal value from the unfailed throttle position sensor is out of the predetermined sensor-abnormality diagnostic criterion range;

unconditionally continuing to hold the opening of the throttle valve at the predetermined default opening when the unfailed throttle position sensor is operating abnormally;

setting the desired opening of the throttle valve based on a sensor signal value from an unfailed accelerator position sensor of the two accelerator position sensors at a single accelerator-position sensor failure mode where one of the two accelerator position sensors is failed;

feedback-controlling the opening of the throttle valve by the desired opening based on the sensor signal value from the unfailed accelerator position sensor, to initiate a fourth failsafe mode;

executing a diagnosis on abnormality in the unfailed accelerator position sensor by comparing the sensor signal value from the unfailed accelerator position sensor with a predetermined threshold value correlating with an idling condition of the engine during the fourth failsafe mode and during idling;

determining that the unfailed accelerator position sensor is operating abnormally when the sensor signal value from the unfailed accelerator position sensor is above the predetermined threshold value; and unconditionally continuing to hold the opening of the throttle valve at the predetermined default opening when the unfailed accelerator position sensor is operating abnormally.

21. The method as claimed in claim 20, wherein the fourth failsafe mode is inhibited responsively to the deceleration indicative signal from said vehicle-deceleration sensor during the fourth failsafe mode and then the throttle valve is held at the predetermined default opening.

* * * * *